US005810216A

United States Patent [19]

Leopold

[11] Patent Number: 5,810,216

[45] Date of Patent: Sep. 22, 1998

[54] GARMENT HANGER AND STORAGE DEVICE THEREFORE

[76] Inventor: Hillel Leopold, #3 Sumner Heights Drivel, Willowdale, Ontario., Canada, M2K 1Y2

[21] Appl. No.: 610,929

[22] Filed: Mar. 5, 1996

Related U.S. Application Data

[63] Continuation-in-part of Ser. No. 463,672, Jun. 5, 1995, abandoned.

[51] Int. Cl.[6] ..... A47G 25/40; A47G 25/14

[52] U.S. Cl. ..... 223/85; 223/94

[58] Field of Search ..... 223/85, 88, 89, 223/92, 94; D6/315

[56] References Cited

U.S. PATENT DOCUMENTS

| | | | |
|---|---|---|---|
| 1,162,613 | 11/1915 | Kalina | 223/94 |
| 1,253,608 | 1/1918 | Lambert | 223/94 |
| 2,728,499 | 12/1955 | Mueller | 223/94 |
| 2,881,965 | 4/1959 | Fetko | 223/94 |
| 4,586,524 | 5/1986 | Smith | 223/94 |
| 5,085,337 | 2/1992 | Chew | 223/94 |
| 5,085,358 | 2/1992 | Lam | 223/94 |

FOREIGN PATENT DOCUMENTS

| | | | |
|---|---|---|---|
| A-1342005 | 9/1963 | France . | |
| 503486 | 8/1930 | Germany | 223/94 |
| A-649207 | 5/1985 | Switzerland . | |
| 320000 | 10/1929 | United Kingdom . | |
| 328828 | 5/1930 | United Kingdom . | |
| 354526 | 8/1931 | United Kingdom . | |
| 759905 | 10/1956 | United Kingdom . | |
| A-3485423 | 12/1969 | WIPO . | |

*Primary Examiner*—Bibhu Mohanty
*Attorney, Agent, or Firm*—Sim & McBurney

[57] ABSTRACT

A collapsible garment hanger and storage device therefor, the hanger including a central upstanding support formation carrying an opposed pair of garment engaging arm formations connected at their innermost ends in next adjacent relation to the lowermost region of the support formation so as to swing from a collapsed upper limit position closely flanking the central support formation to a lower limit garment supporting position projecting outwardly in cantilever fashion therefrom, the central support formation and arm formations having dimensions and a configuration such that the hanger takes on a streamlined or arrowhead-like configuration so as to easily pass through the neck opening of the garment and upon release of the arm formations within the garment to smoothly engage with the inner shoulder regions thereof and descend therewith to the lower limit garment supporting disposition; the hanger presenting a ring-like extension lowermost for grasping the hanger for suspending same in upside down collapsed disposition for storage; the storage device including a rod-like element projecting outwardly and upwardly at an angle to the horizontal from a support formation and of a configuration in cross section so as to register within the ring-like extension of the hanger.

11 Claims, 9 Drawing Sheets

GARMENT HANGER AND STORAGE DEVICE THEREFORE

This application is a continuation-in-part of U.S. Ser. No. 08/463,672, now abandoned.

FIELD OF THE INVENTION

This invention relates to improvements in garment hangers which are collapsible into configurations for ready insertion into or withdrawal from the garments, preferably through the neck openings thereof.

BACKGROUND OF THE INVENTION

The more common garment hangers take the form of a one-piece generally triangularly shaped rigid structure presenting an upstanding centrally-located hook for suspending same. Such hangers are derived from wooden components, lengths of stiff wire or stamped from metal sheeting or moulded from plastic or combinations thereof and appropriately dimensioned for accommodating a wide range of garment sizes and weight.

When utilizing such hangers manipulation of the garments is required in order to properly position the opposed arms or wings within the shoulder regions to achieve the desired engagement or placement and suspension of same.

In the case of a sweater or blouse with a confined neck opening the rigidified hanger can be inserted from below through the waist opening and passed upwardly so that the hook protrudes from the neck opening and the arms or wings register with the internal shoulder regions.

Withdrawal is accomplished by reversing those steps.

There is always a risk that the hook formation or other exposed edge of such rigidified hangers will catch in the material as the hanger is passed upwardly through the garment or withdrawn therefrom.

Alternatively the arms can be inserted or withdrawn one at a time through the neck opening. This will most likely distort or stretch the surrounding fibres or material to some extent and tend to cause damage.

Also with such a hanger a shirt, blouse or jacket can be placed within the garment before it is done up but this entails more handling and time expended.

It is evident that because of the required manipulation or handling of the garment with such hangers greater care must be taken to minimize soiling and avoid damage especially where more delicate articles, such as lingerie, blouses or sweaters are concerned, and particularly if the articles are new and are to be displayed for sale.

A number of published proposals for garment hangers that are collapsible for storage appears from the following U.S. Pat. Nos.: 678,073; 900,567; 1,162,613; 1,319,784; 2,413,221; 2,629,525; 2,881,965 and 5,007,562.

None of the foregoing address the need for a hanger that would be collapsible in a manner for greater ease in engaging with and disengaging from the garment so as to reduce handling or distortion and particularly where such an article or garment is to be displayed for sale.

U.S. Pat. No. 2,728,499 reveals a garment hanger including a central base with an upstanding hook upon which base opposed arm formations are mounted to swing downwardly for presentation to and passage through the neck opening of the garment whereupon under the forces generated by a spring element the arms swing upwardly to a locked position to engage and support the garment.

U.S. Pat. No. 4,988,201 discloses a collapsible garment hanger wherein arm formations are similarly displaceable downwardly for insertion through the neck opening of the garment and then extended within the garment by manipulation of the components and locked in position.

The locked arm formations of the aforementioned hangers of U.S. Pat. Nos. 2,728,499 and 4,988,021 within the garment are releasable by manipulation of the components thereof for withdrawal.

Both latter proposals are somewhat complex as to structure and as to aspects of manufacturing same and in utilization. Moreover, such garment hangers mirror to considerable extent the drawbacks of the aforementioned rigidified hangers.

OBJECTS OF THE INVENTION

It is an object of this invention, therefore, to provide an improved hanger for ready use with a wide range of garments which is collapsible into a generally streamlined configuration for insertion through the neck openings of such garments which when fully entered then smoothly cooperates with the garment itself so as to readily extend and fully support same thereon thereby minimizing manipulation or handling of the garment in such a step.

It is also an object of this invention to provide an improved garment hanger that can be readily reversely collapsed for withdrawal upon releasing the hanger from its supporting disposition within the garment.

It is intended that with this improved simplified collapsible garment hanger the risk of soiling or damage to the garments can be reduced so that their newness or freshness and the materials are preserved particularly in commercial establishments where wearing apparel is displayed for sale and removed for customer fittings and rehung.

It is also a very important object of this invention to provide an overall structure and configuration for such a garment hanger which will closely conform to the contours of the shoulder regions and so preserve the style or look when the garments are to be individually displayed for viewing.

Another significant object is to achieve the foregoing with a minimum of components of relatively simple structure so that the costs of manufacture and assembly can be kept low, yet the hanger is possessed of sufficient inherent strength and resistance to deformation as to accommodate a wide range of garment sizes and weight.

Still another important object is to provide a collapsible garment hanger whose components can be appropriately shaped or moulded if desired so as to compliment the particular styles to be displayed or to serve as an indication of origin or source of the garments that are offered for sale.

FEATURES OF THE INVENTION

The principal feature of this invention resides in providing a collapsible garment hanger which includes an elongated central upstanding support formation having a suspending hook formation or its equivalent uppermost, an opposed pair of like elongated smoothly contoured garment-engaging arm formations with the inner ends thereof connected to the lower region thereof in next adjacent relation for displacement in a common plane from a collapsed upper limit position flanking the support formation to a lower limit garment supporting position projecting outwardly in cantilever fashion therefrom and reversely, the components being so shaped and of an extent that when the arm formations are collapsed the hanger takes on a streamlined or arrowhead-like configuration such that when presented to the neck opening the lower region and collapsed arm formations are readily passed therethrough, and upon their release smoothly, slidingly engage with the inner shoulder regions of the garment and through displacement of the support formation in the reverse direction descend to the lower limit garment-supporting position to fully register with and support the garment therefrom.

This improved garment hanger, according to the invention, can also be readily disengaged under displacement of the support formation inwardly of the neck opening and by supporting the garment so that the arm formations are released therefrom for displacement toward the collapsed upper limit position whereupon withdrawal through the neck opening can be accomplished in a reverse step.

More particularly it is a feature of this invention to provide a connection between the support formation and respective opposed arm formations in the form of a hinge-like structure with barrel-like and pintle-like components which are shaped to limit the degree of movement and so establish the collapsed upper and lower limit positions.

It is also an important feature to provide the opposed arm formations with a smooth upwardly arched contour preferably terminating outermost in depending rounded tips so as to ensure sliding engagement with the inner surfaces of the shoulder regions as the arm formations descend to the lower limit position, thereby minimizing the likelihood of any catching or pulling of any fibres or seams and to enhance full support of the garment thereupon.

Still another feature of this invention resides in providing the garment hanger with a depending extension lowermost, preferably of a ring-like configuration by which the garment hanger can be grasped from below to orient the opposed arm formations within the garment or to withdraw the hanger through the waist opening if desired.

Alternatively by supporting the garment so that the depending extension can be upwardly disposed the arm formations swing downwardly to flank the central support formation and assume the collapsed disposition thereby easing withdrawal from the garment through the neck or waist opening.

It is also a feature of this invention to utilize the ring-like extension for suspending the garment hanger from a suitable projection for storage in that with the ring-like extension uppermost the suspended garment hanger assumes a stable collapsed disposition.

It is a further feature of this invention to provide a novel storage device for the improved hanger in the form of a rod-like element projecting outwardly from a suitable support preferably in the form of a hanger with the rod-like element having a cross-section and so inclined upwardly from the horizontal when suspended that the ring-like extension will engage thereover and slide down from the rod tip towards the support.

Another important feature resides in providing components which can be fashioned or moulded in shapes which tend to minimize the material weight yet maintain the required structural strength to carry the applied loads.

Still another feature resides in providing the improved garment hanger with a stabilizing component preferably of a generally upstanding cup-shaped configuration slidably mounted upon the support formation to closely surround the hinge-like connections from below and confine them against separation and of an extent upwardly to engage and support the opposed arm formations in the regions next adjacent to the hinge-like connections in the lower limit position and under displacement upwardly to swing them towards the collapsed upper limit position flanking the support formation for presentation to the neck opening of a garment.

THE DRAWINGS

These and other objects and features will become apparent from the description of the preferred embodiments of the invention to follow, to be read in conjunction with the sheets of drawings in which.

DESCRIPTION OF THE INVENTION

Figure 1:
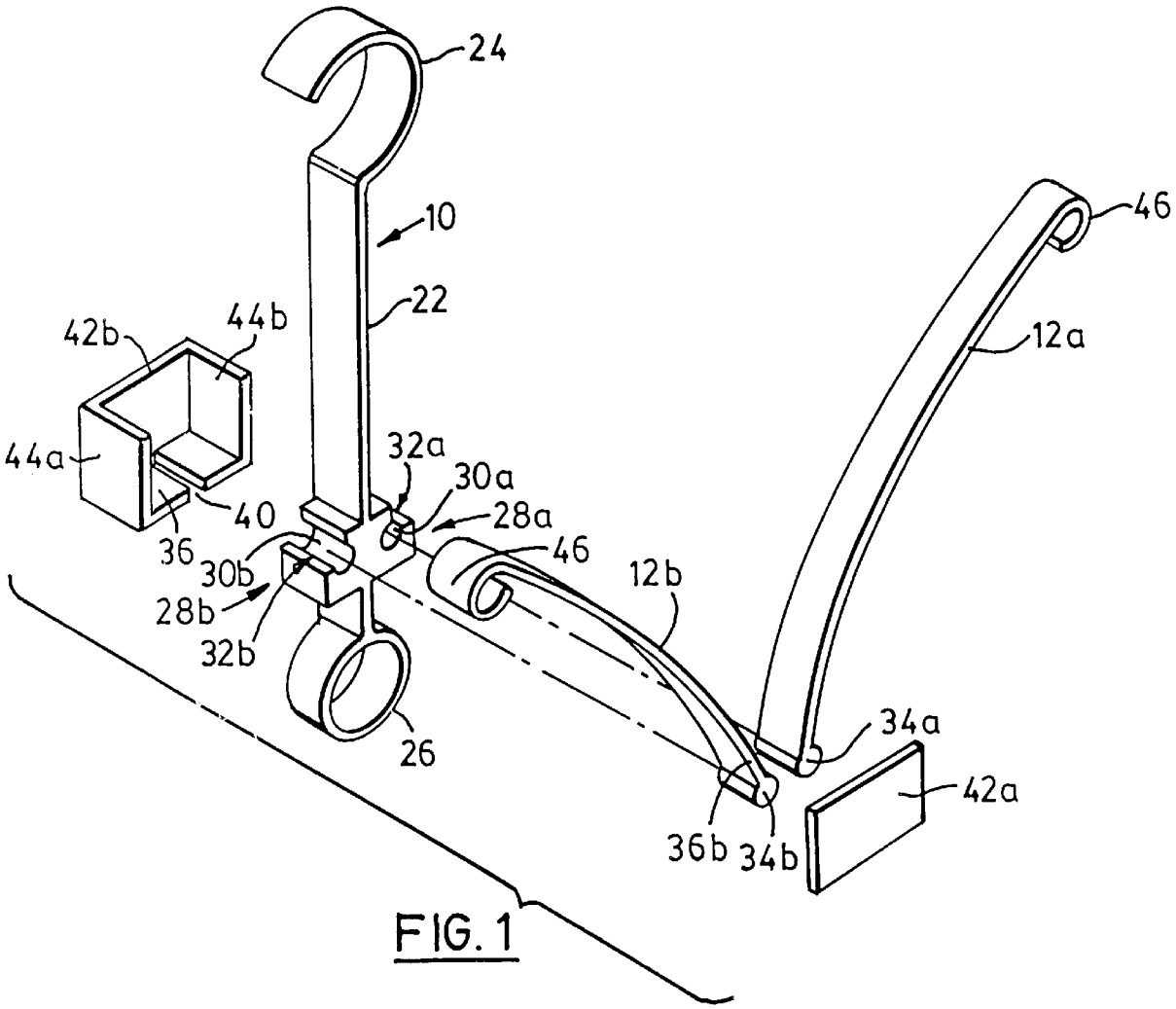
FIG. 1 is an exploded view of one preferred embodiment of the invention, illustrating how the components of the improved garment hanger are assembled.
Figure 3:
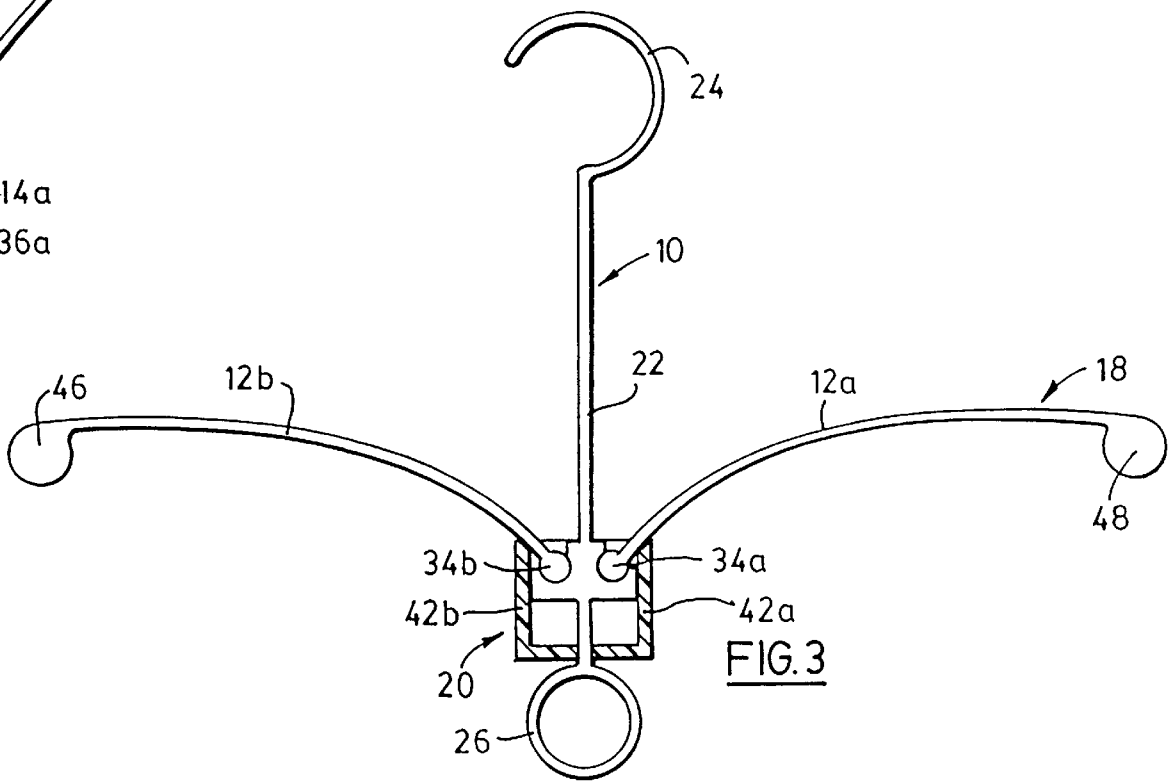
FIG. 3 is a front elevational view, similar to FIG. 2, depicting the opposed arm formations having descended to the lower limit position for engagement with and support of a garment thereupon.
Figure 2:
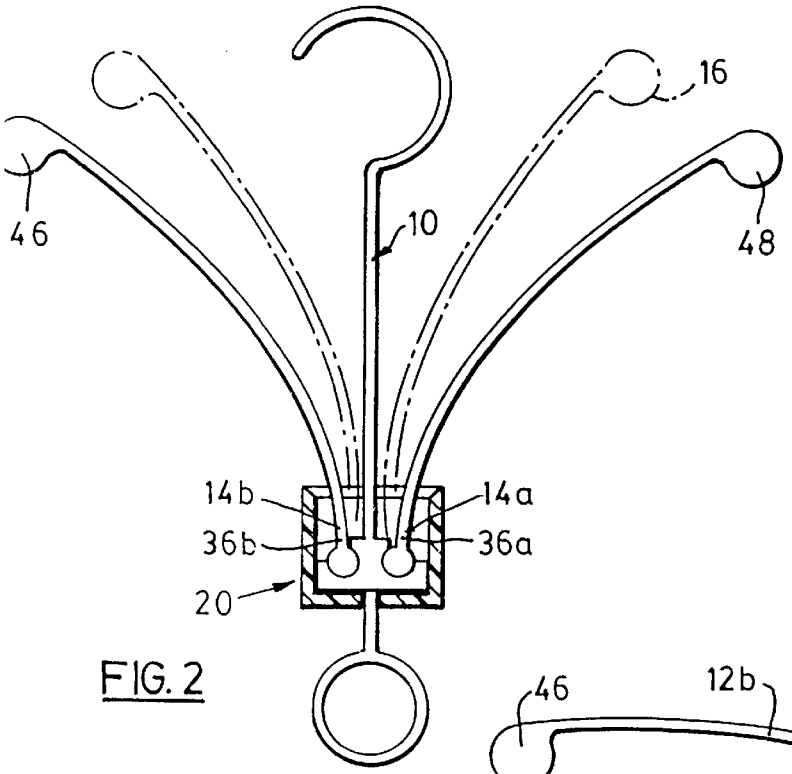
FIG. 2 is a front elevational view of the assembled garment hanger of FIG. 1, with the stabilizing element shown in vertical cross-section to reveal the hinge-like connections between the opposed arm formations and the central support formation, with the upper limit position depicted in broken outlines.

The embodiment of the improved garment hanger illustrated in FIGS. 1 to 3 inclusive, includes a central support formation 10 and an opposed pair of garment engaging arm formations 12*a*, 12*b* interconnected as at 14*a*, 14*b* respectively, by hinge-like structures. The hinge-like interconnections 14*a*, 14*b* provide for swinging movement from an upper limit position 16 as illustrated in broken outline in FIG. 2 to a lower limit position 18 as illustrated in FIG. 3.

A displaceable stabilizing member 20, shown in two parts in the exploded view of FIG. 1, embraces interconnections 14*a*, 14*b* to maintain full engagement thereof and through upward movement imparted thereto serves to swing the opposed arm formations 14*a*, 14*b* from the lower limit position 18 of FIG. 3 to the upper limit position 16 of FIG. 2 for the purposes earlier outlined and to be later described in more detail.

Central support formation 10 includes an upstanding principal element or member 22 terminating uppermost in a suspending hook formation 24 and lowermost in a depending ring-like extension 26 lying generally in the plane of the arm formations 12*a*, 12*b*.

Principal member 22 in the lower region thereof next above the ring-like extension 26 and in spaced relation thereto presents opposed part cylindrical mirror image recesses 28*a*, 28*b*, each constituting one part of the hinge-like interconnections 14*a*, 14*b* and compare to a hinge barrel.

The opposed part cylindrical recesses 28*a*, 28*b* are open at their ends and along their upper outer quadrants so as to define an appropriate separation or passageway as at 32*a*, 32*b* therealong respectively opening outwardly as indicated which constitute sockets 30*a*, 30*b*.

The opposed pair of garment engaging arm formations 12*a*, 12*b* which present opposed pintle-like elements 34*a*, 34*b* lowermost each having a part cylindrical configuration corresponding to the part cylindrically shaped sockets 30*a* and 30*b*, respectively, and appropriately dimensioned for the required registration and rotary movement therewithin.

In this embodiment gaps 32*a*, 32*b* are suitably dimensioned for the registration therewithin of segments 36*a*, 36*b* of the opposed arm formations 12*a*, 12*b* next above pintle-like components 34*a*, 34*b* with the degree of separation of the edges of gaps 32*a*, 32*b* determining the extent of swinging movement of arm formations 12*a*, 12*b* between the collapsed upper limit position 16 and upon release their descent to the lower garment engaging limit position 18.

As an alternative the pintle-like elements 34*a*, 34*b* could be mounted on the central support formation 10 and the barrel-like sockets 30*a*, 30*b* presented by the lower ends of arm formations 12*a*, 12*b* respectively so as to constitute the requisite connections.

Displaceable cup shaped stabilizing member 20 in the preferred embodiment closely embraces interconnections 14*a*, 14*b* as illustrated in FIGS. 2 and 3 and includes lower wall 38 suitably slotted as at 40 and upstanding surrounding uniformly spaced-apart side walls 42*a*, 42*b* and end walls 44*a*, 44*b*.

Slot 40 is dimensioned for sliding engagement upon central support formation 10 between ring-like extension 26 and interconnections 14*a*, 14*b*.

End walls 44*a*, 44*b* of displaceable member 20 have an appropriate upward extent in the lowermost position illustrated in FIG. 3 so as to closely flank the opposed ends of pintle-like elements 34*a*, 34*b* and thereby serve to maintain their registration with sockets 30*a*, 30*b*.

It will be understood that the registration of the pintle like elements 34*a*, 34*b* within the sockets 30*a*, 30*b* can be maintained with alternative fittings, for example by providing each pintle-like component with an extension on either end, each to be provided with a suitable retaining cap of a diameter exceeding the diameter of the pintle-like components and sockets and contoured to be either snap-fitted thereover or otherwise secured thereto by fasteners, adhesives or the like. Such alternative fittings are known to persons skilled in the art.

Displaceable cup shaped member 20 as depicted in FIG. 3 is seated upon ring-like extension 26 and so disposed the side walls 42*a* and 42*b* have an upward extent such that they engage segments 36*a*, 36*b* of opposed arm formations 12*a*, 12*b* in fully outwardly extended cantilevered support from the central support formation 10, establishing the lower limit position 18. With this arrangement reinforcing of the connections and additional strengthening of the structure are provided.

The upper surfaces of side walls 42*a*, 42*b* of displaceable member 20, as illustrated in FIG. 2, can be suitably shaped so as to smoothly slidingly engage the under surfaces of opposed arm formations 12*a*, 12*b* as displaceable member 20 is moved upwardly to swing them toward the upper limit position 16 and to flank the central support formation 10.

More particularly according to the preferred embodiments of the invention arm formations 12*a*, 12*b* will have a slightly upwardly arched or curvate configuration terminating at their outer ends in either a smoothly rolled tip 46 or an enlarged smoothly curvate tip 48.

Figure 4:
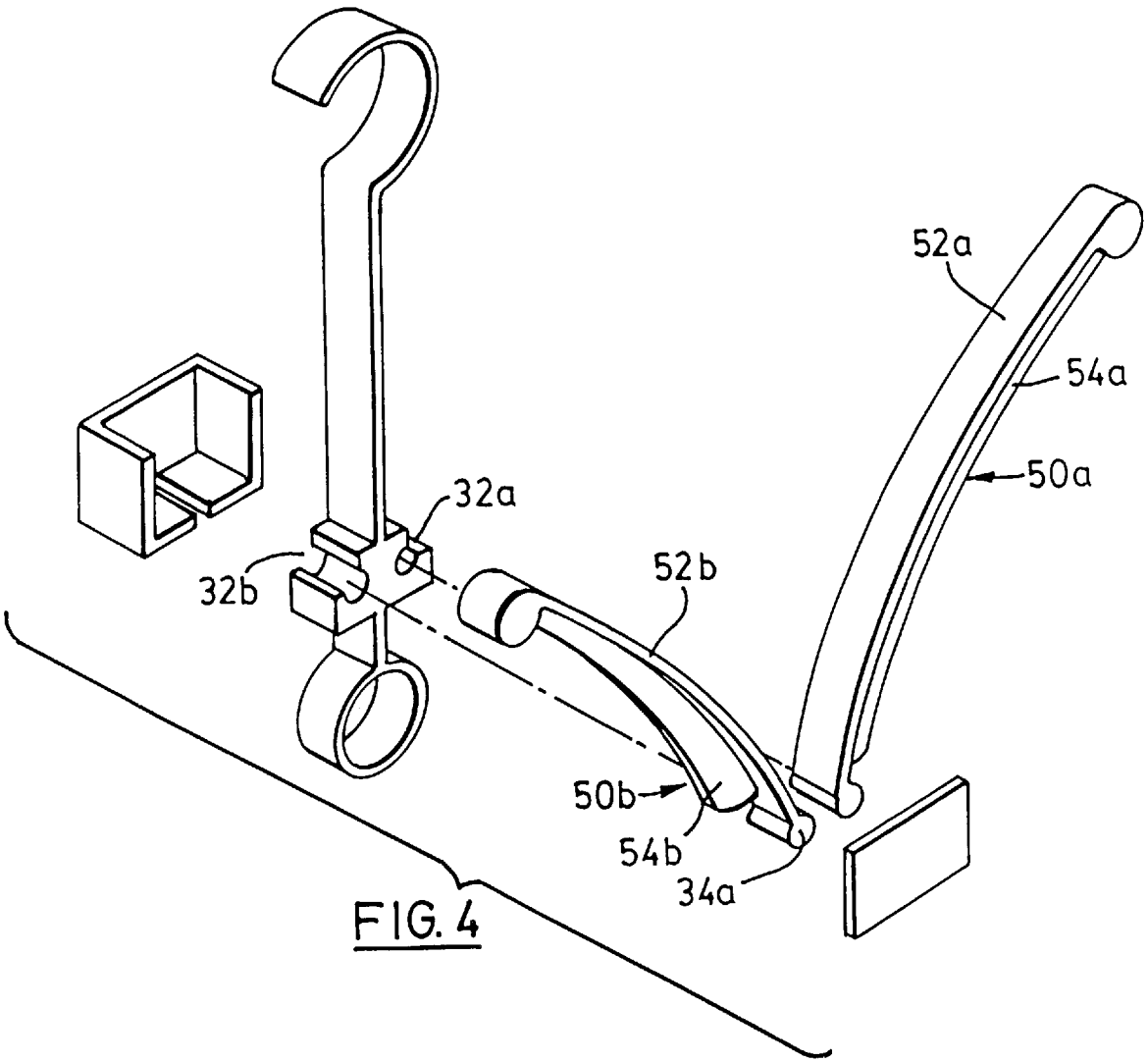
FIG. 4 is an exploded view of a garment hanger embodying the invention similar to the structure of FIG. 1 and illustrating modified opposed arm formations.

The garment hanger illustrated in the exploded view of FIG. 4 corresponds essentially to the structure of FIGS. 1 to 3, inclusive, and the components thereof that correspond have been designated with the same numerals.

In this embodiment modified arm formations 50*a*, 50*b* are substituted wherein the upper garment engaging segments 52*a*, 52*b* likewise having a slight curvature upwardly are reinforced by centrally located depending ribs 54*a*, 54*b* preferably dimensioned so that the inner ends will bear against side walls 42*a*, 42*b* of displaceable member 20 when disposed in the lower limit position 18.

Thus with this alternative embodiment can additional resistance to bending under the weight of heavier garments be imparted and the overall structure strengthened.

Obviously other or additional ribbing can be introduced to further reinforce the arm formations 12*a*, 12*b* or 50*a*, 50*b* or the central support formation 10 of the embodiments illustrated.

In FIGS. 11 to 16 inclusive an alternative structure embodying the invention is illustrated In this modification the central support formation $\mathbf{10}^1$ is provided with an opposed pair of elongated arm formations $\mathbf{12}^1a$, $\mathbf{12}^1b$ interconnected by hinge-like structures as at $\mathbf{14}^1a$, $\mathbf{14}^1b$, respectively.

Figure 11:
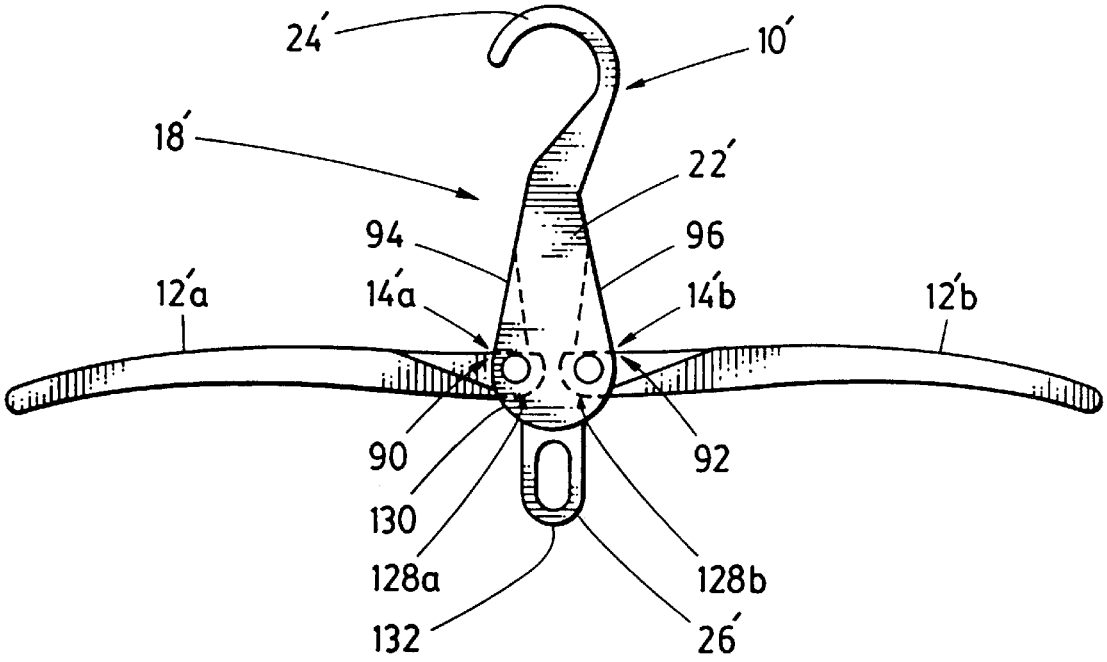
FIG. 11 is a front elevation of a modified garment hanger embodying the invention shown in the extended garment supporting disposition.
Figure 16:
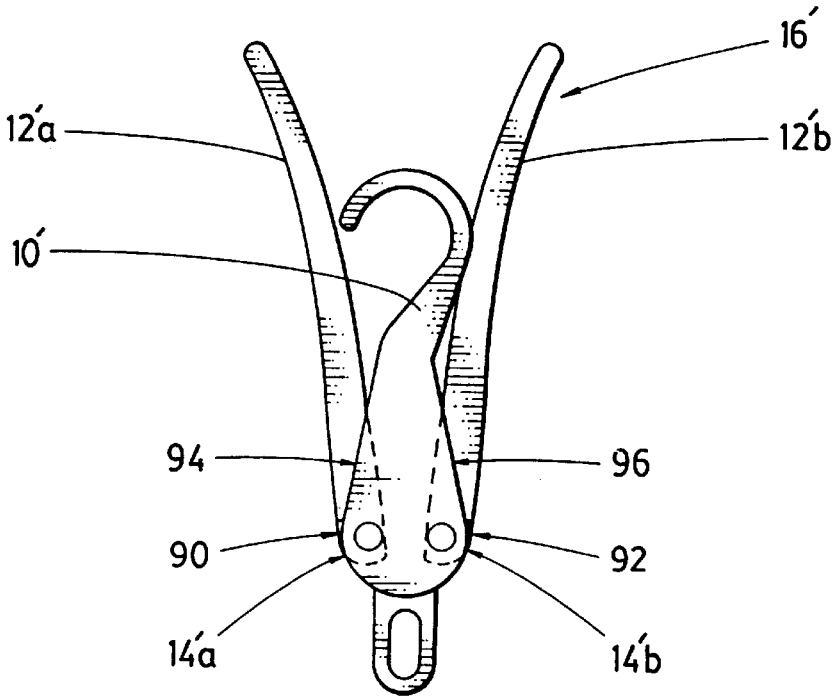
FIG. 16 is a perspective view of the modified garment hanger of FIG. 11 shown in the collapsed disposition ready for insertion within the neck opening of a garment or for withdrawal therefrom.

Hinge-like interconnections $\mathbf{14}^1a$, $\mathbf{14}^1b$ provide for displacement or swinging movement from an upper limit position $\mathbf{16}^1$ as illustrated in FIG. 16 to a lower limit position $\mathbf{18}^1$ as illustrated in FIG. 11.

Central support formation 10[1] includes upstanding principal element or member 22[1], terminating uppermost in a suspending hook formation 24[1] and lowermost in a depending ring-like extension 26[1] lying generally in the plane of arm formations 12[1]*a*, 12[1]*b*.

Figure 14:
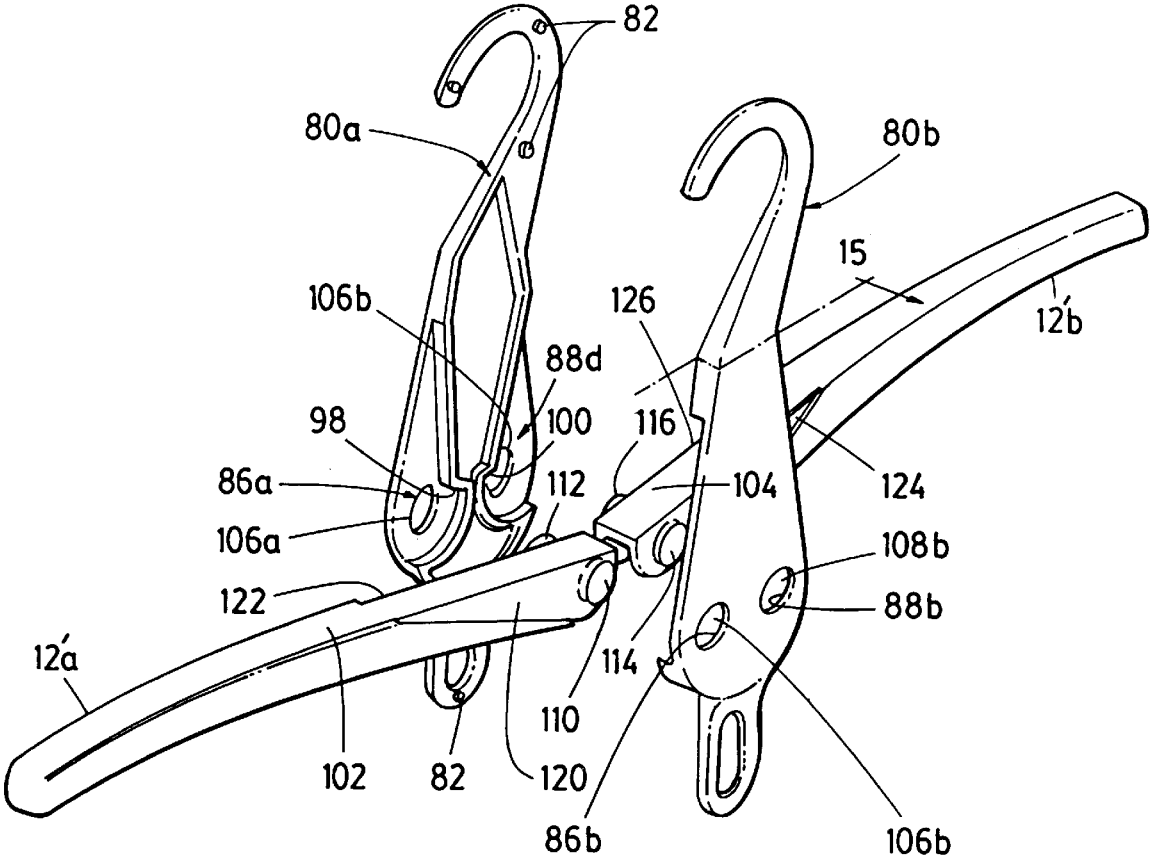
FIG. 14 is an exploded view of the several components of the modified garment hanger of FIG. 11 shown in perspective illustrating how such components are assembled.

Central support formation 101 in this embodiment is derived from opposed mating sections 80*a*, 80*b*, as detailed in FIG. 14 which are of opposite symmetry except for the provision of mating projections 82 and cooperating recesses 84, presented respectively by the opposed surfaces of the sections 80*a*, 80*b*.

The mating projections 82 and cooperating recesses 84 align as well as join the opposed sections 80*a*, 80*b* when pressed together to establish a snap fit accompanied by electronic welding of the seams of the joined sections, if desired, when moulded from a suitable plastic.

Each section 80*a*, 80*b* includes opposed contoured recesses 86*a*, 88*a* and 86*b*, 88*b* respectively lowermost.

When sections 80*a*, 80*b* are joined together the respective contoured recesses 86*a*, 86*b* and 88*a*, 88*b* respectively define opposed open-sided part-cylindrical hollow receptacle portions 90, 92, which merge with upwardly extending open sided generally wedge-shaped hollow receptacle portions 94, 96 respectively within which the inner ends of arm formations 12[1]*a*, 12[1]*b* are adapted to register as will be shortly described.

It will be noted that in the region of the merger of the respective receptacle portions 90, 92 and wedge-shaped portions 94, 96 the intervening wall portions as at 98, 100 extend in a generally horizontal direction which in relation to the part-cylindrical receptacle portions 90, 92 can be characterized as part chord-like.

The wall portions 98, 100 cooperate with upper surfaces, 102, 104 of the inner ends of opposed arm formations 12[1]*a*, 12[1]*b* respectively to limit displacement downwardly as appears from the broken outline in FIG. 11.

Each section, 80*a*, 80*b* is provided with a pair of apertures 106*a*, 108*a*, 106*b*, 108*b*; respectively, centrally of contoured recesses 86*a*, 86*b*, 88*a*, 88*b* respectively, which are so shaped as to mate in rotating fit with opposed pintle-like projections 110, 112 and 114, 116 presented by respective inner ends of arm formations 12[1]*a*, 12[1]*b*.

Arm formations 12[1]*a*, 12[1]*b* are preferably generally channel-shaped as revealed by FIG. 14. Such channel-shaped configuration ensures substantial resistance to deformation under reasonable loading from above.

Also to be noted is that the inner ends of the depending walls of channel-shaped arm formations 12[1]*a*, 12[1]*b* are progressively recessed as at 120, 122, 124, 126. So configured each presents a generally wedge-shape configuration matching the configuration of open-sided wedge-shaped receptacle portions 94, 96 respectively of central support formation 201 whereby nesting of the inner ends within central support formation occurs when arm formations 12[1]*a*, 12[1]*b* are collapsed upwardly to take the confined positions shown in FIG. 16.

The inner ends of channel-shaped formations 12[1]*a*, 12[1]*b* preferably have a part-circular configuration as illustrated in broken outline in FIG. 11 as at 128*a*, 128*b* respectively and in solid outline in FIG. 14 to match the shaping of the part-cylindrical hollow receptacle portions 90, 92 for partial rotary displacement therewithin.

The upper surfaces 102, 104 of arm formations 12[1]*a*, 12[1]*b* in the region of the inner ends thereof are adapted to fully engage chord-like wall portions 98, 100 of hollow receptacle portions 90, 92 with arm formations 12[1]*a*, 12[1]*b* extending outwardly in cantilever fashion for supporting the garment as illustrated in FIG. 11.

The elongated arm formations 12[1]*a*, 12[1]*b* are also smoothly contoured and have a slight upwardly curvate configuration terminating outermost in smoothly rounded depending ends as depicted in FIG. 11.

Also to be noted is that the arm formations 12[1]*a*, 12[1]*b*, as in the other embodiments, are connected to the lower region of central support formation 10[1] in next adjacent relation so as to minimize the lateral extent of the lower region of the support formation to which the arm formations are attached.

Figure 12:
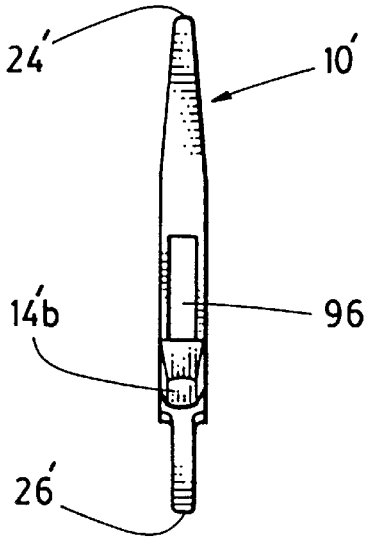
FIG. 12 is a side elevational view of the modified garment hanger as it appears in FIG. 11.

Moreover, arm formations 12[1]*a*, 12[1]*b* are seen to lie in a common plane with the plane of central support formation 10[1] as revealed by FIGS. 12 and 14.

Upon swinging arm formations 12[1]*a*, 12[1]*b* upwardly the wedge-shaped portions of the inner ends thereof enter into and progressively register or mate with the respective wedge-shaped hollow receptacle portions 94, 96 of the central support formation 10[1].

In that disposition it will be observed that the peripheral configuration of the lower region of central support formation 10[1] is appropriately rounded as at 130 in FIGS. 11 and 16 as is the depending ring extension 26[1] as at 132.

Having regard to the foregoing it will be seen in FIG. 16 in particular that the garment hanger takes on a streamlined or arrowhead-like configuration so as to easily pass through the neck opening of a garment.

Also having regard to the upwardly slightly curvate configuration and depending rounded ends of arm formations 12[1]*a*, 12[1]*b* when entered within the garment it will be understood that upon their release from confinement they commence to smoothly engage with the inner shoulder regions thereof and descend therewith to the lower limit garment-supporting disposition.

MANUFACTURE AND ASSEMBLY OF COMPONENTS

It is intended that the principal components of the garment hangers be moulded from a suitable plastic possessing sufficient inherent resistance to deformation and deterioration under loading and climatic conditions.

Separate moulds will be required for the central support formations 10 and 10[1] whereas opposed arm formations 12*a*, 12*b*, 50*a*, 50*b* and 12[1]*a*, 12[1]*b* respectively being identical can be produced from a single mould.

So far as displaceable stabilizing member 20 is concerned it presents a plane of symmetry and therefore can be constructed from two identical parts produced from a single mould.

Central support formation 10, the arm formations 12*a*, 12*b* or alternative arm formations 50*a*, 50*b* are assembled together in the manner illustrated by the aligned centre lines of the respective sockets and pintles in the exploded views of FIGS. 1 and 4 by registering the pintle-like elements 34*a*, 34*b* within sockets 30*a*, 30*b* through their open ends with the segments 36*a*, 36*b* aligned with the gaps 32*a*, 32*b*.

This step is followed by the registration of the opposed parts of displaceable cup shaped member 20 in position below the hinge-like interconnections 14*a*, 14*b* and above the extension 26 and appropriately sealing them or welding them together to confine the pintle-like elements 34*a*, 34*b* within sockets 30*a*, 30*b* and serve the other purposes already outlined.

Figure 15:
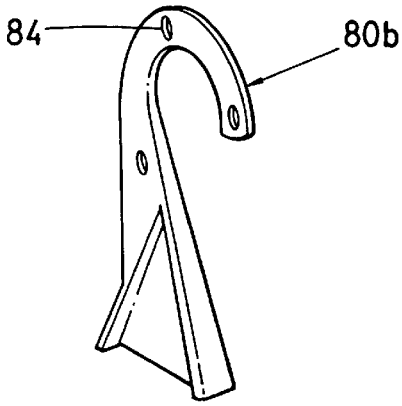
FIG. 15 is a perspective view of the upper portion of one section of the central support formation broken away along the line 15—15 as indicated in FIG. 14 to illustrate how such sections are joined.
Figure 13:
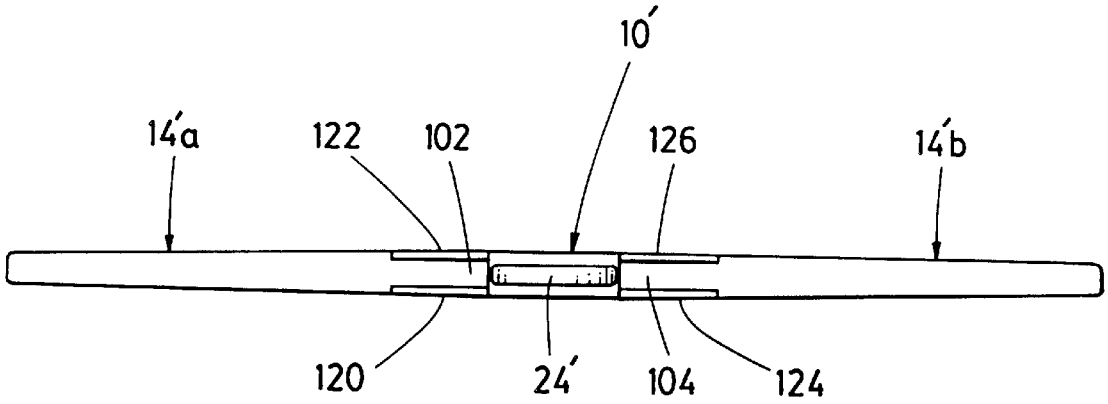
FIG. 13 is a top plan view of the garment hanger as it appears in FIG. 11.

So far as the embodiment illustrated in FIGS. 11 to 16 is concerned sections 80*a*, 80*b* constituting central support formation $10^1$ as represented in FIGS. 14 and 15 and arm formations $12^1a$, $12^1b$ are arranged in alignment as indicated by the broken centre lines 134 and 136 in FIG. 14 whereby sections 80*a*, 80*b* can then be press-fitted together to bring projections 82 into engagement with matching recesses 84 and against separation as in a snap fit.

Also by this step pintles 110, 112 and 114, 116 brought into registration within the opposed matching openings 106*a*, 106*b* and 108*a*, 108*b* of the respective sections 80*a*, 80*b* whereby the inner ends of arm formation $12^1a$, $12^1b$ are captured for partial rotation or displacement and whereby with that step a fully operative garment hanger embodying the invention produced.

UTILIZATION OF INVENTION

The improved garment hangers so constructed are intended to be utilized in the following manner.

Having regard to the embodiments of FIGS. 1 and 4 and FIG. 11 to 16 with arm formations 12*a*, 12*b* or the alternatives, 50*a*, 50*b* or $12^1a$, $12^1b$ urged toward the respective upper limit positions flanking the upstanding central support formation 10 or $10^1$ the garment hangers so collapsed take on a streamlined or arrowhead-like configuration with the separation between the arm formations being reduced a substantial extent so that entry through the neck opening of a garment can be readily accomplished.

More particularly the garment hangers when collapsed assume a planar disposition. With the arm formations 12*a*, 12*b*, 50*a*, 50*b* or $12^1a$, $12^1b$ so held in or confined to the upper limit positions 16, $16^1$ respectively the garment hanger is oriented for introduction of same through the neck opening until the arm formations pass therethrough.

Upon release of the arm formations and by drawing the central support formation upwardly the respective arm formations extend and with the rounded tips thereof brought upwardly into supporting engagement with the inner shoulder regions of the garments the opposed arm formations smoothly descend under increased loading into the lower limit garment supporting positions.

To remove the garment and hanger from the garment through the neck opening the above steps can be reversed with the garment suitably supported so as to enable collapsing of the hanger within the garment.

Also with the garment and hanger suitably supported the hanger can be removed through the waist opening by grasping the depending ring-like extension and drawing the central support formation and associated arm formations towards the waist opening which causes collapse of the garment hanger as earlier outlined which facilitates withdrawal from below.

Thus with the use of this improved, collapsible garment hanger can manipulation and/or handling of garment to be hung or removed therefrom be significantly lessened and any soiling or other risk of damage reduced.

ALTERNATIVE HOOK MOUNTING

Figure 5:
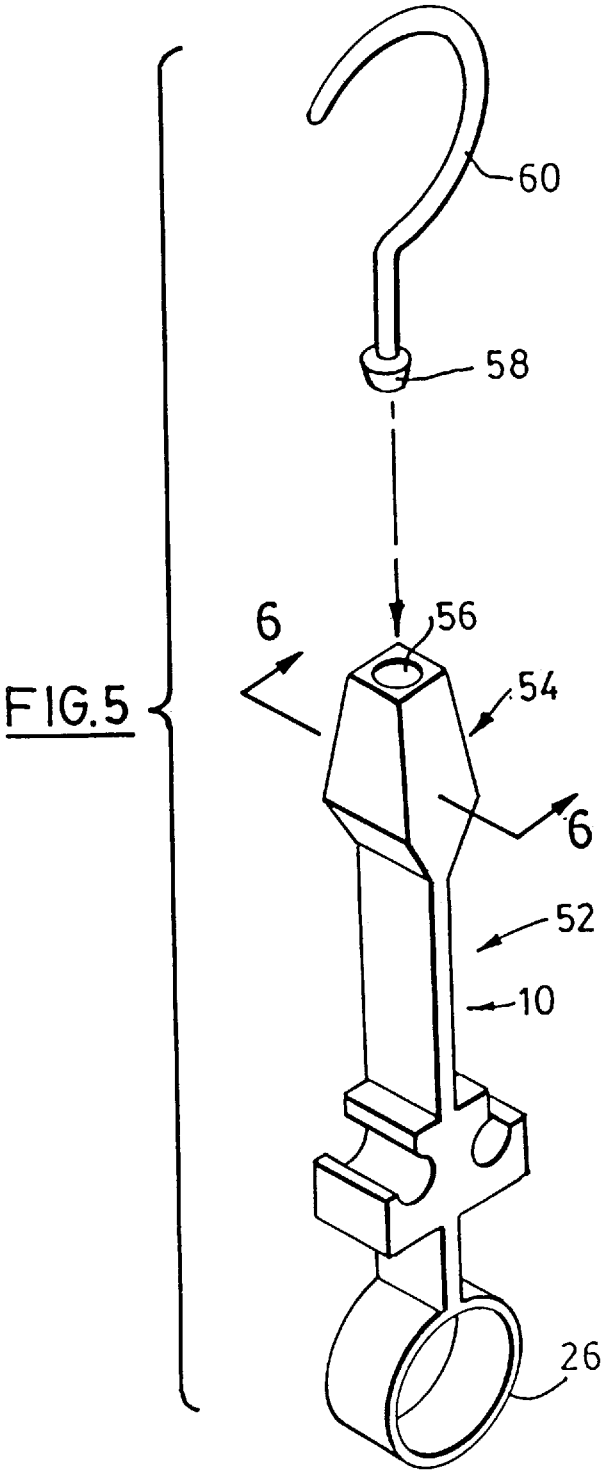
FIG. 5 is a perspective view of a modified central support formation for the garment hanger of FIGS. 1 to 4, illustrating a swivel mounting for a modified suspending hook formation.
Figure 6:
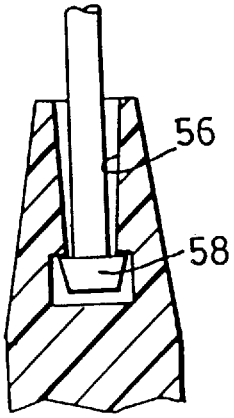
FIG. 6 is a vertical cross-sectional view of the central support formation of FIG. 5, taken along the lines 6—6 of FIG. 5 to illustrate the detail of the swivel connection with the adjoining structure broken away.

In FIG. 5 a modified central support formation 52 for the collapsible hanger of FIGS. 1 or 4 and other embodiments is illustrated.

In this alternative central support formation 52 is provided with an enlarged section uppermost recessed as at 56 to provide a vertical channel open at the top and terminating lowermost in an enlarged cavity. The enlarged cavity is shaped so as to receive an enlarged suitably shaped lower end or foot 58 of a modified hook formation 60 in rotary fit.

So configured as illustrated in FIG. 5 the hook formation 60 is swivelly mounted within section 54 to provide for ease in mounting the improved garment hanger in a closet, in a display structure or otherwise.

ALTERNATIVE INTERCONNECTIONS

Figure 10:
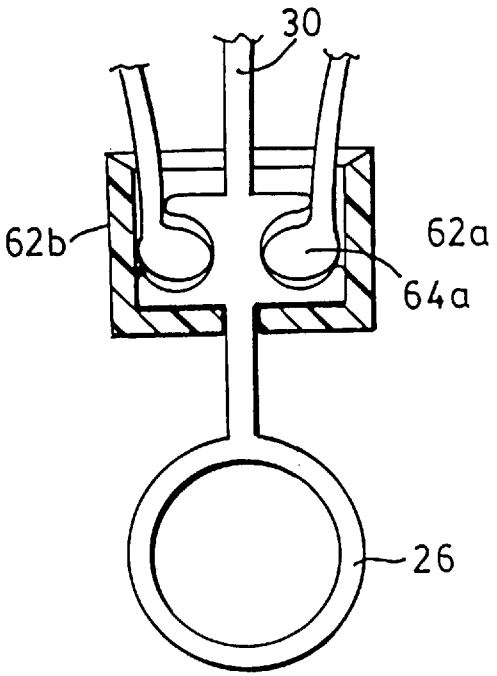
FIG. 10 is a view similar to FIG. 2 revealing the disposition of the components of the alternate hinge-like connections detailed in FIG. 9 in the upper limit position with the central support formation and opposed arm formations broken away.
Figure 9:
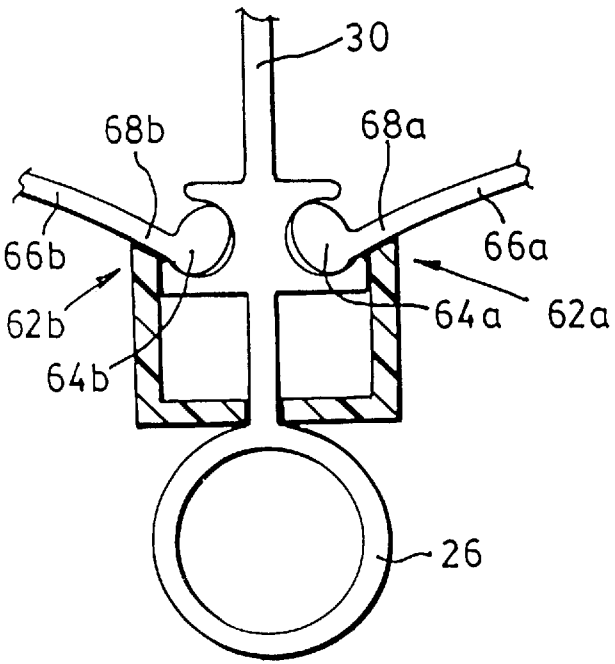
FIG. 9 is a view similar to FIG. 3 revealing the disposition of the components of alternate hinge-like connections for the garment hanger with the central support formation and opposed arm formations broken away and in the lower limit position.

According to FIGS. 9 and 10 alternative interconnection 62*a*, 62*b* can be utilized in which a part ovate or part elliptical configuration is applied to the pintle-like elements 64*a*, 64*b* for registration within the part-cylindrical open-ended sockets 30*a*, 30*b* the major axis of the part elliptically-shaped pintle-like elements corresponding to the diameter of the part cylindrically-shaped sockets.

In this arrangement the arm formations 66*a*, 66*b* are offset from the foci of the part elliptically=-shaped pintle-like elements 64*a*, 64*b* and extend generally tangentially in relation to the major axis, as illustrated, so that segments 68*a*, 68*b* in the lower limit position can be brought into full aligned registration with the opposed contoured upper edges of the displaceable element 20 as illustrated in FIG. 9.

Also the upper edges 67*a*, 67*b* of the gaps 32*a*, 32*b* can either be turned down more sharply or extended if desired to better confine the part elliptically-shaped pintle-like elements 64*a*, 64*b* as well as to further limit the upward winging movement of the arm formations 66*a*, 66*b*.

Thus is increased support imparted to arm formations 66*a*, 66*b* and their interconnections whereby increased overall stability of the structure is achieved with the garment hanger extended in the garment-supporting disposition.

STORAGE DEVICE

Figure 7:
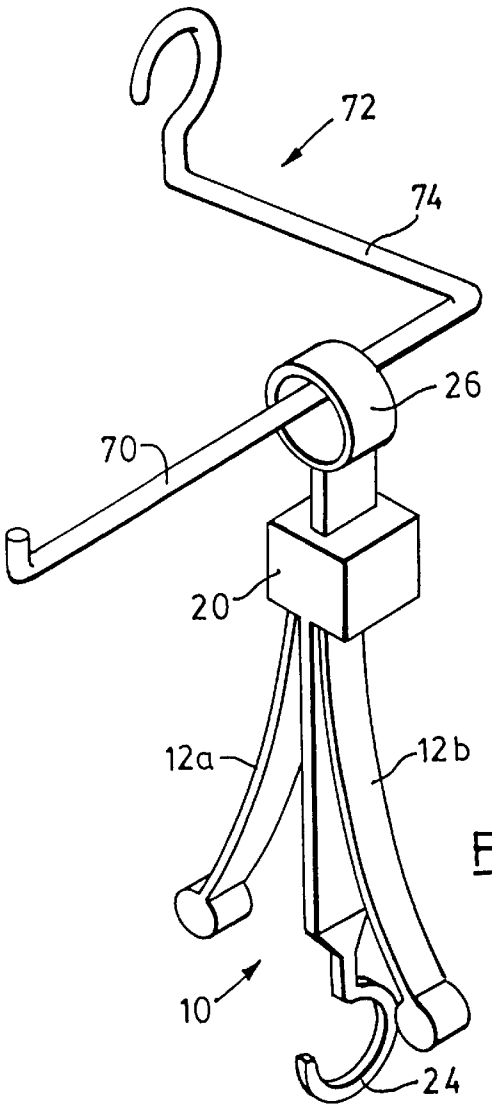
FIG. 7 is a perspective view of an assembled garment hanger similar to FIG. 1 but showing the ring extension uppermost and with the opposed arm formations extending downwardly flanking the central support formation and with the ring-like extension engaged over the rod extension of the novel storage device therefor.

In FIG. 7 the hanger is shown turned up-side-down with the ring-like extension 26 disposed uppermost and engaged over a projecting rod-like segment 70 presented by a novel storage hanger device 72 which in turn is to be suspended from a suitable support, preferably by means of an integral hook formation 73.

So disposed as in FIG. 7 the garment hanger depending from ring-like extension 26 assumes its collapsed disposition with displaceable cup shaped element 20 descending to surround interconnections 14*a*, 14*b* and through engagement confine arm formations 12*a*, 12*b* against movement outwardly and so stabilize the structure in that disposition for storage purposes.

Figure 8:
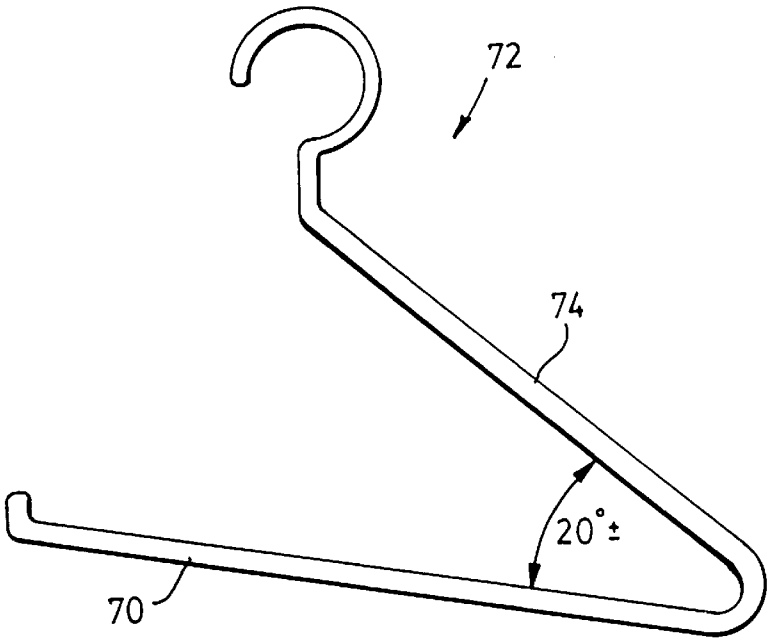
FIG. 8 is an elevational view of the novel storage device for the novel garment hangers of FIGS. 1 to 7.

Rod-like segment 70 and supporting segment 74 of storage hanger device 72 preferably have a generally linear extent and present a contained angle of the order of 20 degrees at their intersection, with the intersection offset from the point of suspension as illustrated in FIG. 8 whereby rod-like segment 70 will be supported to angle slightly upwardly.

With hanger device 72 itself suspended the first and subsequent garment hangers so engaged over rod-like segment 70 by means of their ring-like extensions 26 will descend in sequence therealong towards the intersection of segments 70, 74. This applied load swings suspended hanger device 72 in a direction to maintain the load in balance yet will continue to present rod-like segment 70 upwardly at an angle to the horizontal so as to preserve the interengagement.

Thus not only does storage device 72 facilitate effective storage for the improved garment hangers but also provides for ready access to them when the storage hanger device 72 is hung in a closet or at a work station in a commercial establishment or otherwise.

Whereas the preferred embodiments of the novel garment hanger and storage device therefor have been described and illustrated variations or alterations in the structure can be undertaken by those persons skilled in the art without departing from the spirit and scope of the invention as defined by the following claims.

What I claim is:

1. In a garment hanger, a central upstanding support formation including means for suspending same from the upper region thereof so as to depend generally vertically therefrom and presenting opposed side regions, an opposed pair of like elongated generally smoothly contoured arm formations having inner and outer ends respectively with opposed means connecting each of said inner ends to the lower region of said central support formation in spaced apart relation so as to extend outwardly of said side regions and confine same to swing in a common plane from an upper collapsed disposition flanking said central support formation to a lower outwardly projecting garment supporting disposition, said opposed connecting means including a pair of socket means each opening oppositely outwardly to a respective side region and upwardly thereof with the inner end of each respective arm formation disposed therewithin, and pintle-like means securing the lower end of each said arm formation within said respective socket means and so shaped as to orient said arm formation to swing in said common plane and wherein each said socket means has a configuration so as to define a passageway for the reception of the lower end of each respective arm formation and the region next above said pintle-like means therewithin, said passageway having a separation sufficient for said arm formation to swing from said upper collapsed disposition to said lower garment supporting disposition.

2. A garment hanger according to claim 1 wherein said central support formation is comprised of opposed mirror image components joined together and wherein said opposed socket means is presented by said components to extend therebetween and said pintle-like means is presented by each said respective lower end of said arm formations to each said respective opposed socket means whereby said joined together components secure said arm formations therein against separation.

3. A garment hanger according to claim 1 wherein said opposed arm pair of arm formations each have an upwardly curvate configuration and terminate at their outer ends in smoothly rounded tip formations.

4. A garment hanger according to claim 3 wherein said opposed pair of arm formations include an upper transverse section having an integral reinforcing rib section depending therebelow and extending therealong.

5. A garment hanger according to claim 1 wherein said opposed pair of arm formations each have a generally channel-shaped configuration with the open side thereof opening downwardly.

6. A garment hanger according to claim 1 wherein said central support formation includes a depending extension lowermost disposed generally in the plane of said arm formations for orienting same for entry into the neck opening of a garment and withdrawal therefrom.

7. A garment hanger according to claim 1 wherein said central support formation includes a suspending hook member uppermost, said hook member having a depending foot formation and means presented by said central support formation embracing said depending foot formation for rotary support therefrom whereby said central support formation is swivelly connected thereto.

8. A garment hanger according to claim 1 wherein each said socket means has a part cylindrical configuration and said pintle-like means has a part cylindrical configuration matching same with each said respective arm formations extending generally diametrically outwardly therefrom.

9. A garment hanger according to claim 1 wherein each said socket means has a part cylindrical configuration and said pintle-like means has a part elliptical configuration whose major axis matches the diameter of said part cylindrical configuration of said respective socket means with each said respective arm formation extending outwardly from said pintle-like means in substantial tangential relation to said major axis.

10. A garment hanger according to claim 1 wherein displaceable means is carried by said central support formation below said opposed pair of socket means, said displaceable means having a configuration and upward extent under displacement so as to engage said opposed arm formations from below and to swing same from said lower supported disposition upwardly towards said upper collapsed position.

11. A garment hanger according to claim 10 wherein said displaceable means has an upwardly opening cup-shaped configuration with said central support formation presenting stop means therebelow to limit the downward descent thereof so that lowermost the upward extent of said cup-shaped displacement means closely flanks said connecting means and fully engages the inner ends of said arm formations adjacent said connecting means from below when disposed in the lower supported position thereof.

* * * * *